US005302996A

United States Patent [19]

Hall et al.

[11] Patent Number: 5,302,996

[45] Date of Patent: Apr. 12, 1994

[54] APPARATUS FOR PROCESSING PHOTOSENSITIVE MATERIAL

[75] Inventors: Douglas O. Hall, Canandaigua; Bruce R. Muller, Rochester; David G. Sherburne, Ontario, all of N.Y.

[73] Assignee: Eastman Kodak Company, Rochester, N.Y.

[21] Appl. No.: 981,564

[22] Filed: Nov. 25, 1992

[51] Int. Cl.[5] ..... G03D 3/02; G03D 13/02

[52] U.S. Cl. ..... 354/324; 354/331; 354/336; 354/338

[58] Field of Search ..... 354/319-324, 354/331, 301, 336, 317, 325, 318, 338, 339, 305, 340, 302, 316; 118/662, 647, 637

[56] References Cited

U.S. PATENT DOCUMENTS

| | | | |
|---|---|---|---|
| Re. 27,260 | 12/1971 | MacKenzie | 118/662 |
| 3,236,168 | 2/1966 | Rautbord et al. . | |
| 3,249,088 | 5/1966 | Ostensen | 118/662 |
| 3,263,590 | 8/1966 | Wanielista et al. . | |
| 3,334,613 | 8/1967 | Young . | |
| 3,359,945 | 12/1967 | Hastings et al. | 118/662 |
| 3,375,770 | 4/1968 | Hellyer | 118/662 |
| 3,405,627 | 10/1968 | Day et al. | 354/320 |
| 3,415,223 | 12/1968 | Zweig | 118/662 |
| 3,468,693 | 9/1969 | Hanson . | |
| 3,554,107 | 1/1971 | McCarthy et al. | 354/338 X |
| 3,610,131 | 10/1971 | Frick et al. | 354/320 |
| 3,621,773 | 11/1971 | Limberger et al. . | |
| 3,626,832 | 12/1971 | Kappeler et al. | 354/324 |
| 3,636,925 | 1/1972 | Reuter, Jr. et al. | 118/637 |
| 3,651,782 | 3/1972 | MacDonald, Jr. | 118/637 X |
| 3,682,542 | 8/1972 | MacKenzie | 118/637 |
| 3,824,954 | 7/1974 | Hyosaka et al. | 118/637 X |
| 3,990,088 | 11/1976 | Takita | 354/324 X |
| 4,133,292 | 1/1979 | Takasugi et al. | 118/662 X |
| 4,477,165 | 10/1984 | Spence et al. | 354/339 X |
| 4,511,231 | 4/1985 | Ashby | 354/331 |
| 4,527,509 | 7/1985 | Richardson | 118/662 |
| 4,576,467 | 3/1986 | Yamasaki et al. | 118/647 |
| 4,586,809 | 5/1986 | Miyauchi et al. | 118/662 |
| 4,664,502 | 5/1987 | Fukushima et al. | 354/317 X |
| 4,794,415 | 12/1988 | Larsen | 354/320 |
| 4,989,028 | 1/1991 | Hall et al. | 354/324 |
| 4,994,840 | 2/1991 | Hall et al. | 354/324 |
| 5,032,871 | 7/1991 | Murata et al. | 354/320 |
| 5,043,756 | 8/1991 | Takabayashi et al. | 354/320 |
| 5,059,997 | 10/1991 | Hall et al. | 354/324 |

*Primary Examiner*—D. Rutledge
*Attorney, Agent, or Firm*—Dana M. Schmidt

[57] ABSTRACT

In an apparatus for processing photosensitive material, the apparatus having, a narrow processing chamber formed by a pair of substantially planar guide plates spaced apart a predetermined distance. The processing chamber having an entrance and an exit for allowing the photosensitive material to travel through the processing chamber. A first fluid supply is provided for supplying processing fluid to the processing chamber to create a first fluid layer on one side of the photosensitive material, and a second fluid supply is provided for supplying processing fluid to the processing chamber to create a second fluid layer on the opposite side of the photosensitive material. A plurality of spaced raised projection are disposed on the surface of the guide plates. The projections extend in a substantially perpendicular direction with respect to the direction of travel of the photosensitive material and across substantially the entire width of the photosensitive material.

35 Claims, 9 Drawing Sheets

APPARATUS FOR PROCESSING PHOTOSENSITIVE MATERIAL

FIELD OF THE INVENTION

The present invention relates to an apparatus for processing photosensitive materials, such as sheets of x-ray film.

BACKGROUND OF THE INVENTION

The present invention is directed to a processing apparatus of the type which includes an upper tank and a lower tank for holding processing fluid and a narrow processing chamber located between the tanks through which a sheet of photosensitive material is advanced for processing of latent images on the material. Processing fluid is delivered to opposite sides of the photosensitive material from each of the tanks for forming a fluid layer on each side of the photosensitive material. A return drain is provided on each side of the photosensitive material for removing and returning the processing fluid to the sump tank. Example of such devices are illustrated in U.S. Pat. No. 4,989,028; U.S. Pat. No. 4,994,840; and U.S. Pat. No. 5,059,997.Such devices are often referred to as fluid suspension processors.

In fluid suspension processors of the prior art it is important to maintain the photosensitive material suspended in the processing fluid in the narrow chamber. It has been found that excessive contact of the photosensitive material with the sides of the processing chamber results in numerous undesirable artifacts being produced on the photosensitive material. In this regard, the prior art teaches the providing of flat plates for forming the sides of the narrow processing chamber. The surface of the flat plates may have a plurality of diamond shaped projections which are raised a small distance above the flat plate to prevent the film from sticking to the surface of the flat plate. This solution has not been totally satisfactory. Applicants have found that certain patterns produce a flow pattern which has a tendency to pull the film toward the surface of flat plates such that artifacts are produced on the film.

The present invention is directed to solving the problems experienced in prior fluid suspension processors by providing a pattern on the plate plates that form the sides of the narrow processing chamber which minimizes the tendency of the film of being pulled toward the sides of the processing chamber and thereby minimize contact of the film with the sides of the plates.

SUMMARY OF THE INVENTION

In an apparatus for processing photosensitive material, the apparatus having, a narrow processing chamber formed by a pair of substantially planar guide plates spaced apart a predetermined distance. The processing chamber having an entrance and an exit for allowing the photosensitive material to travel through the processing chamber. A first supply means is provided for supplying processing fluid to the processing chamber to create a first fluid layer on one side of the photosensitive material, and a second supply means is provided for supplying processing fluid to the processing chamber to create a second fluid layer on the opposite side of the photosensitive material. A plurality of spaced raised projection are disposed on the surface of the guide plates. The projections extend in a substantially perpendicular direction with respect to the direction of travel of the photosensitive material and across substantially the entire width of the photosensitive material.

BRIEF DESCRIPTION OF THE DRAWINGS

In the detailed description of the preferred embodiment of the invention presented below, reference is made to the accompanied drawing, in which.

DETAILED DESCRIPTION OF THE PREFERRED EMBODIMENT

Figure 1:
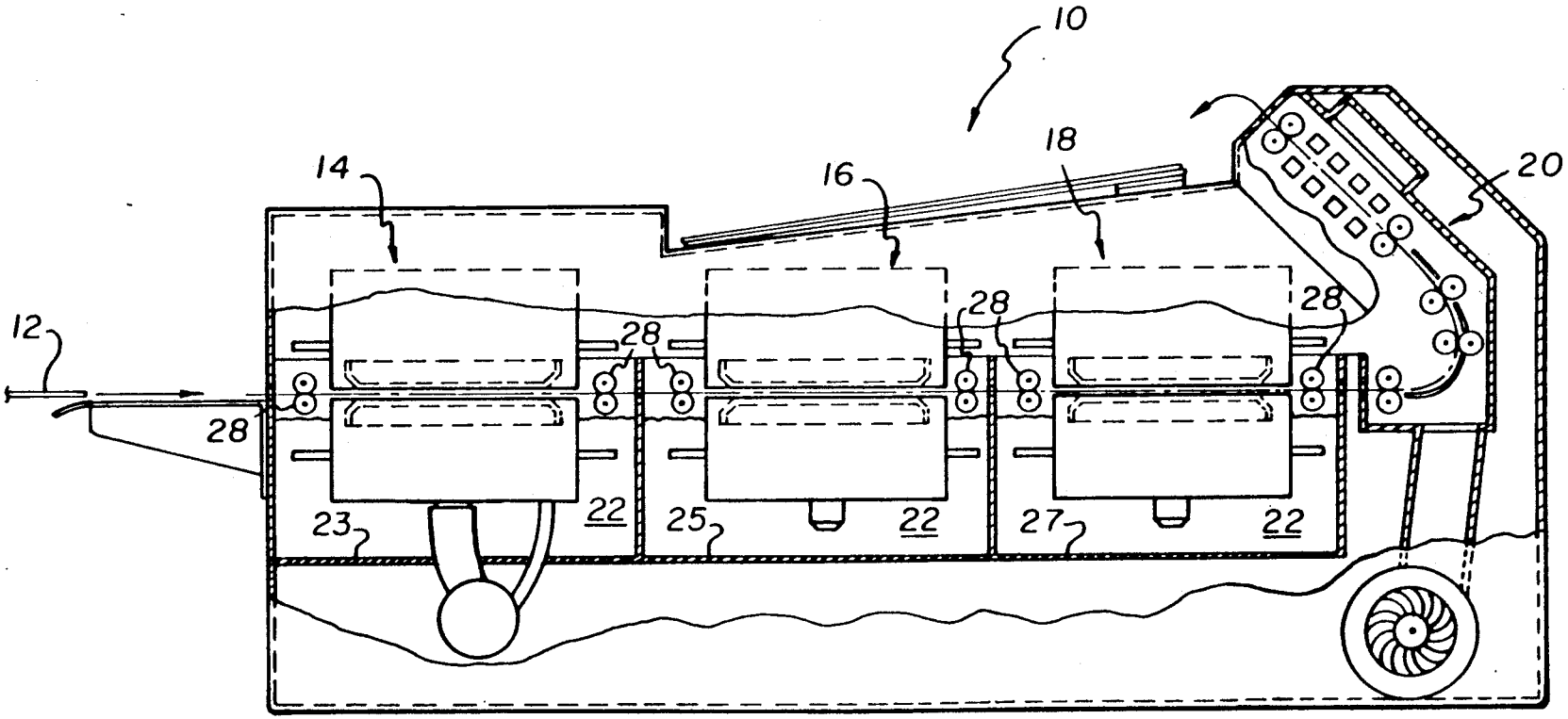
FIG. 1 is a cross-sectional view of a photographic processing apparatus made in accordance with the present invention.
Figure 2:
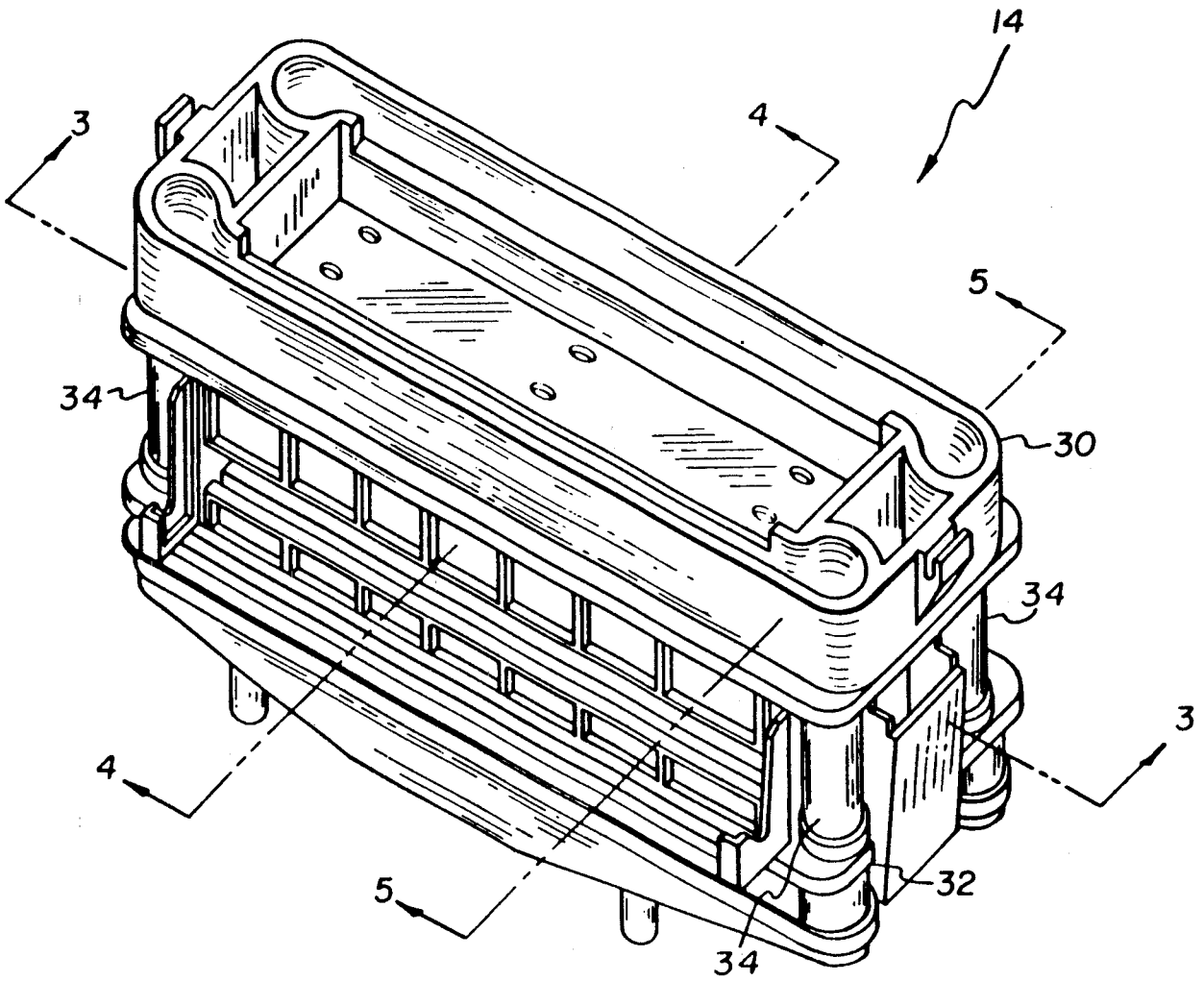
FIG. 2 is perspective view of one of the processing units of the processing apparatus of FIG. 1.
Figure 3:
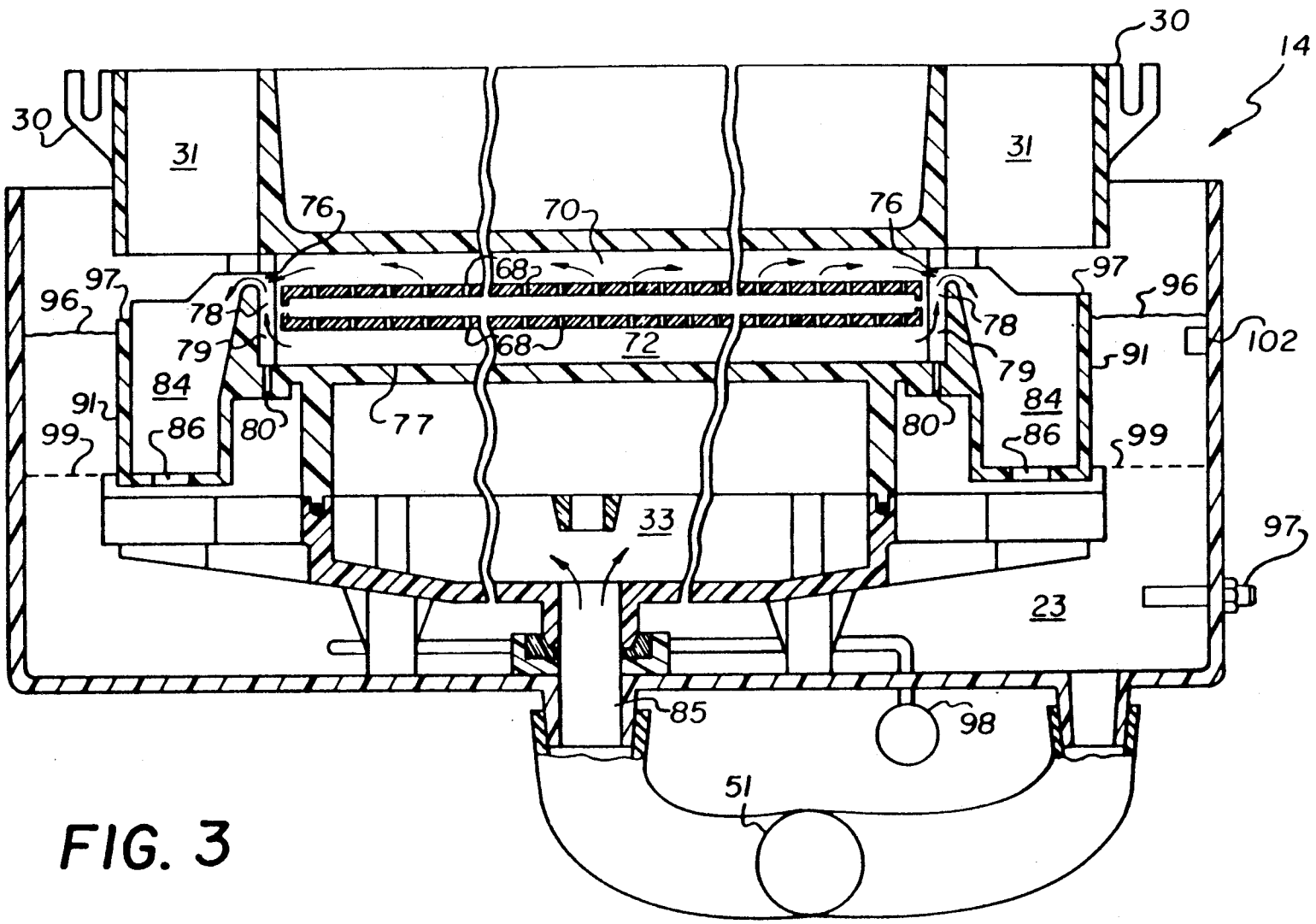
FIG. 3 is a cross-sectional view of the processing unit of FIG. 2 taken along line 3—3.
Figure 4:
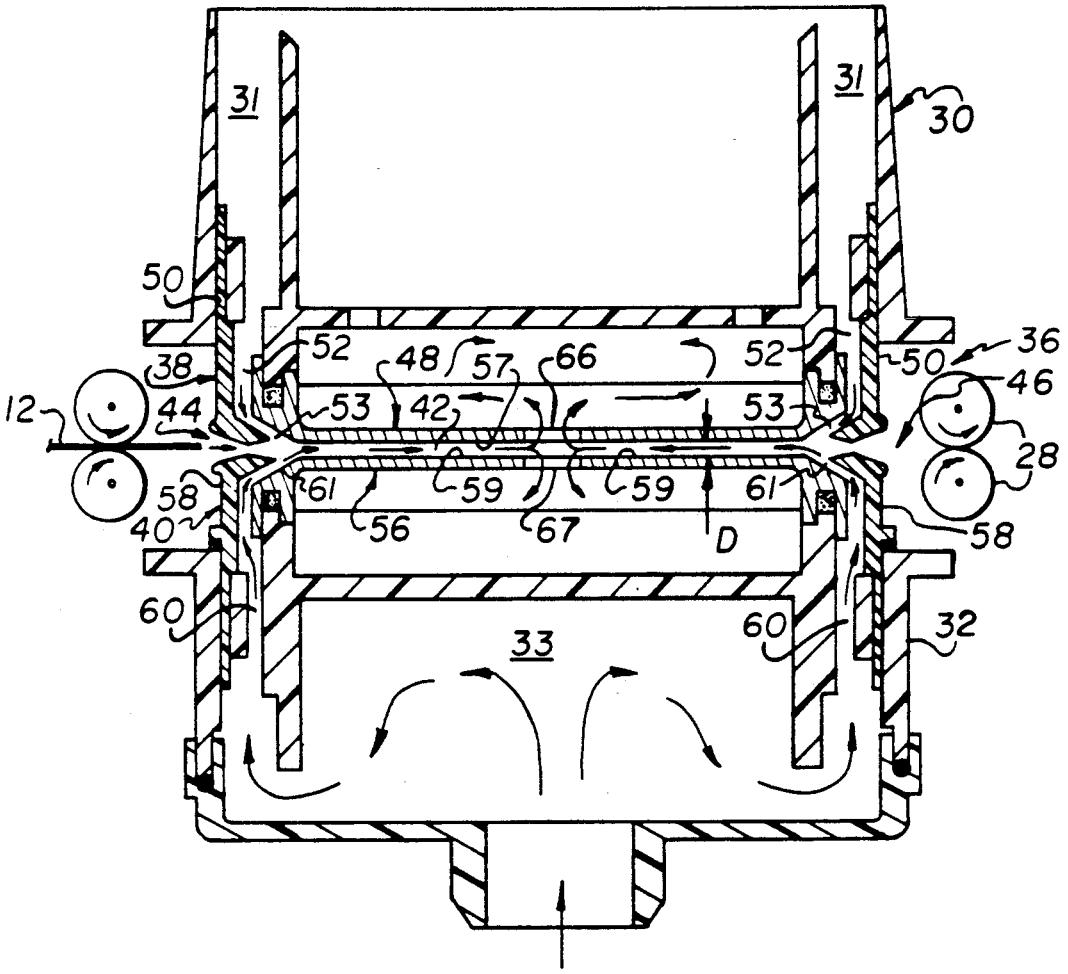
FIG. 4 is a cross-sectional view of processing unit of FIG. 2 as taken along line 4—4.
Figure 5:
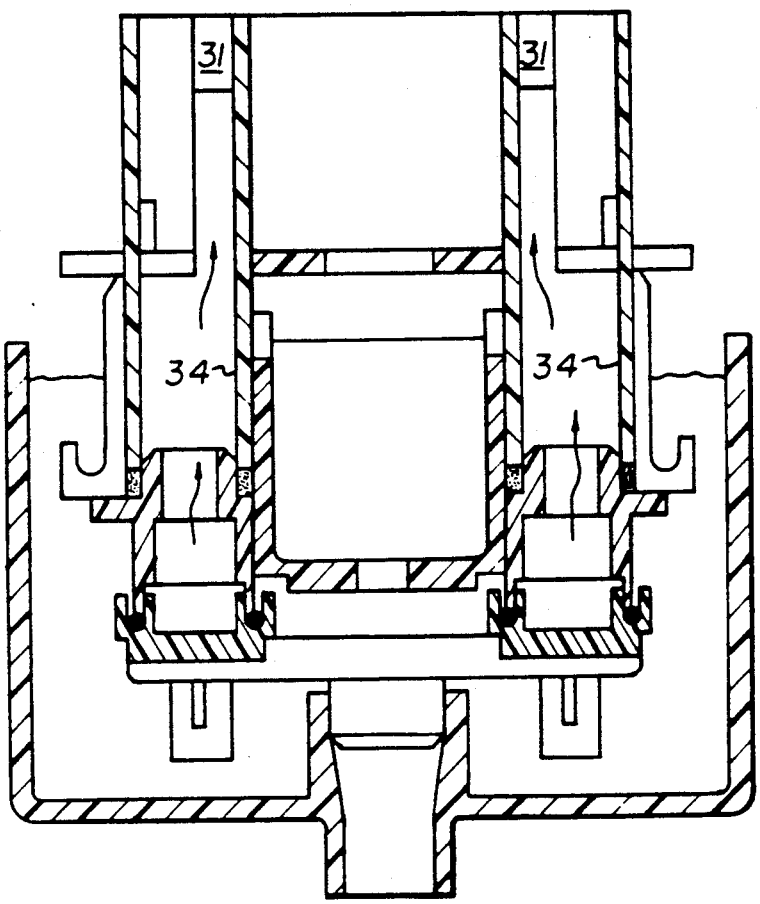
FIG. 5 is a cross-sectional view of the processing unit of FIG. 2 as taken along line 5—5 illustrating how the fluid passes from the lower tank to the upper tank.
Figure 6:
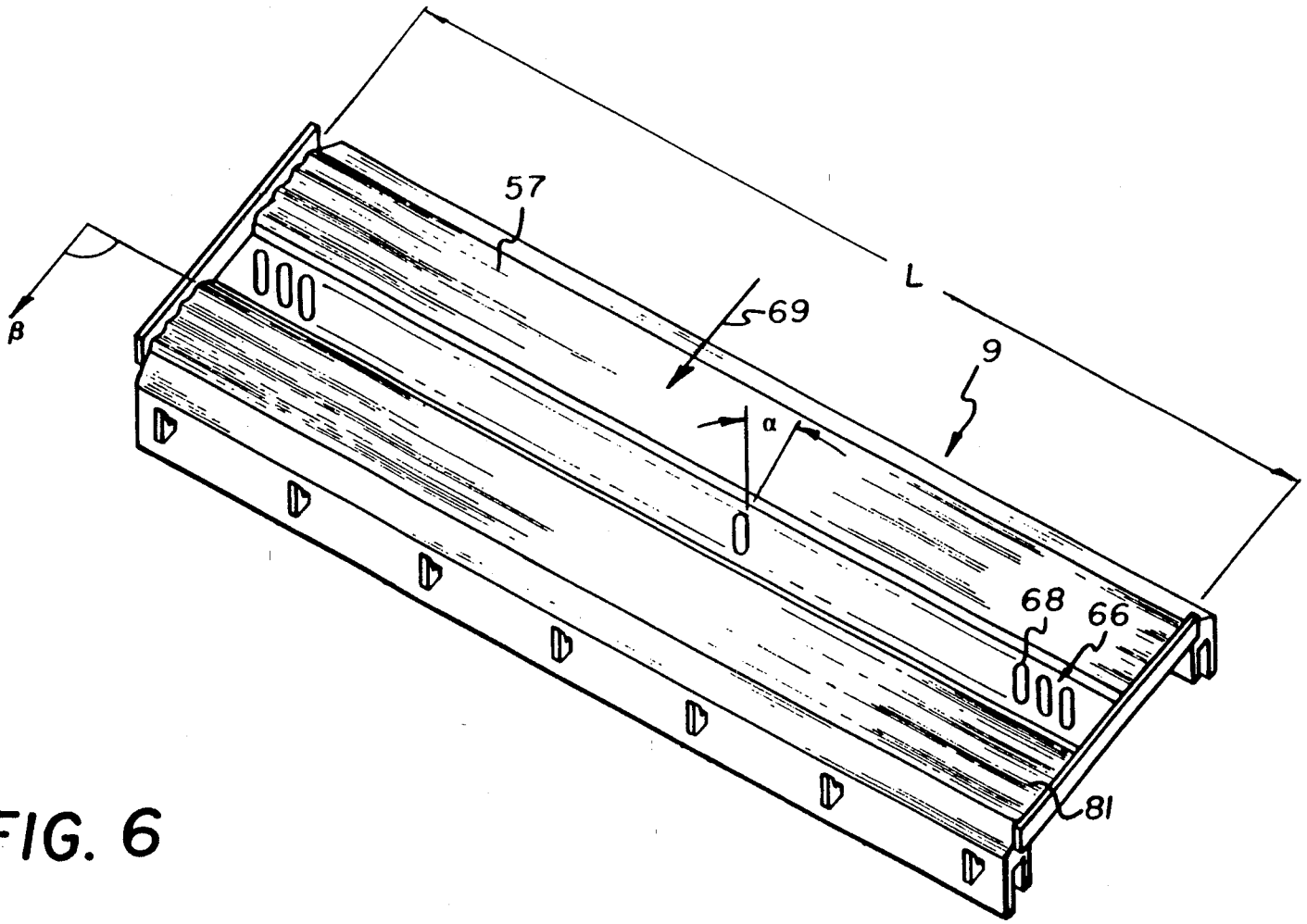
FIG. 6 is a perspective view of one of the inner nozzles/plates which forms one side of the processing chamber for that particular processing unit.

FIG. 1 of the drawings illustrates a photographic processing apparatus made in accordance with the present invention, generally designated 10, that is useful for processing a strip or sheet of photosensitive material 12 (film, paper or other appropriate material). The photographic processing apparatus 10 includes a plurality of photographic processing units, three of which are shown at 14,16 and 18. A processing fluid 22 is supplied to each unit. The processing fluid 22 is generally in a liquid form and includes such photographic processing liquids as developer, fixer, bleach, rinsing fluid, water, or any other fluids for use in the processing of photosensitive material. Any number of photographic processing units can be included in the photographic process apparatus 10 depending upon the number of processing fluids required for processing a specific photosensitive material. The processor may of course include other elements typically found in processors. For example, a dryer 20 may be provided for drying of the photosensitive material. Additionally a processing unit made in accordance with the present invention may be combined with other conventional processing units as desired.

A plurality of sump tanks 23,25,27 for holding a processing fluid 22 are provided for units 14,16,18, respectively. The photosensitive material 12 is conveyed through the apparatus 10 by a plurality of nip rollers 28 associated with the photographic processing units 14,16,18. The nip rollers 28 can be driven by any conventional drive means (not shown).

The photographic processing units 16,18 are the same or similar in construction to the photographic processing unit 14. Therefore only processing unit 14 will be discussed in detail it being understood that the other processing units are similarly constructed. Referring to FIGS. 2–6 processing unit 14 comprises an upper tank 30 and a lower tank 32 having fluid retention chambers 31,33, respectively, for holding processing fluid 22. Four connecting tubes 34 connect the retention chambers 31,33 of tanks 30 and 32 so as to allow processing fluid 22 to flow freely between the upper tank 30 and lower tank 32. The processing unit 14 further includes a processing section 36 located between the upper tank 30 and lower tank 32. The processing section 36 comprises an upper nozzle assembly 38 associated with the upper tank 30 and a lower nozzle assembly 40 associated with lower tank 32. The upper and lower nozzle assemblies 38,40 define a narrow fluid processing chamber 42 through which the photosensitive material 12 travels during processing. The chamber 42 has an entrance 44 through which the photosensitive material enters the chamber 42 and an exit 46 through which the photosensitive material leaves the chamber 42. The upper nozzle assembly 38 includes an inner nozzle/guide plate 48 and a pair of outer nozzles 50 secured to upper tank 30. The inner and outer nozzles 48,50 define a pair of passages 52 which are in fluid communication with the fluid retention chamber 31 of the upper tank 30 and a pair of discharge openings/outlets 53 which extends along substantially the entire length of the tank 30 for dispensing of the processing fluid 22 into chamber 42. The outlets 53 allows fluid 22 to enter chamber 42 and creates a first fluid layer on one side of the photosensitive material 12. The inner nozzle 48 includes a substantially flat central section 57 which forms the top of chamber 42.

The lower nozzle assembly 40 is similar to the upper nozzle assembly 38 in structure and operation except that it is associated with the lower tank 32. The lower nozzle assembly 38 includes an inner nozzle/guide plate 56 secured to the top of tank 32 and a pair of outer nozzles 58 also secured to lower tank 32. The inner and outer nozzles 56,58 define a pair of passage 60 which are in fluid communication with the retention chamber 33 of the lower tank 32 and a pair of discharge openings/-outlets 61 for dispensing of the fluid into chamber 42 so as to create a second fluid layer on the opposite side of the photosensitive material 12. The inner nozzle 56 comprises a substantially flat central section 59 which forms the bottom of chamber 42. The flat sections 57,59 of inner nozzles/guide plates 48,56, respectively, form the narrow processing chamber 42. The flat sections are spaced apart such that the photosensitive material may easily pass through the chamber 42 and a thin fluid processing layer is formed on both sides of the photosensitive material 12. In the particular embodiment illustrated, the sections 57,59 are spaced apart a distance D is about 0.125 inches (0.3175 cms) and is designed to receive a film having a thickness of about 0.007 inches (0.0175 cms).

Processing fluid 22 is exhausted from chamber 42 by a pair of drains 66,67 provided in inner nozzles 48,56. Preferably as illustrated the drains 66,67 are located substantially midway between the entrance 44 and exit 46. The drains 66,67 each comprise at least one opening provided in the substantially flat surfaces of inner nozzles 48,56. In the particular embodiment illustrated, drains 66,67 each comprise a plurality of aligned slots 68 disposed at an angle $\alpha$ with respect to the direction of fluid flow (as indicated by arrow 69 in FIG. 6) across the inner nozzles 48,56. However, the drains 66,67 may comprise any desired number of openings 68 having any desired configuration. Conduits or passageways 70,72 are formed between the inner nozzles 48,56 and tanks 30,32 respectively for exhausting the fluid 22 from the chamber 52. The conduits 70,72 terminate in outlets 76, 78 for emptying the fluid to sump tank 23.

A pair of weirs 91 are provided adjacent the outlets 76,78 for receiving the processing fluid. Each of the weirs 91 including a wall having an upper edge 97 which is adjacent the outlets 76,78 and a receiving chamber 84 into which the fluid 22 flows. The weirs 91 each have an opening 86 in the bottom for allowing fluid to return to the sump tank 23. In the particular embodiment illustrated the weirs 91 each have a substantially rectangular configuration and is sized such that the opening 86 is substantially always below the top of the fluid in sump tank 23. The size of opening 86 is such that the level of fluid 22 within weir 91 will be maintained is slightly below the upper edge 97.

A pump 51 is used to draw processing fluid from the sump tank 23 into the lower input 85 of the lower tank 32. The pump 51 causes the fluid 22 to go into the lower chamber 33, which in turn causes the processing fluid 22 to go into vertical tubes 34 so that processing fluid 22 will fill the upper tank 30 as best seen by reference to FIG. 5. This will cause fluid 22 to fill both the upper and lower tanks 30,32 such that substantially equal fluid pressure is applied to the outlets 53,61 at the entrance 44 and exit 46 of the chamber 42.

A pair of small air vent openings 80 are provided in conduits 72 so as to allow processing fluid 22 to drain from conduits 70,72 when the pump 51 is turned off.

Figure 8:
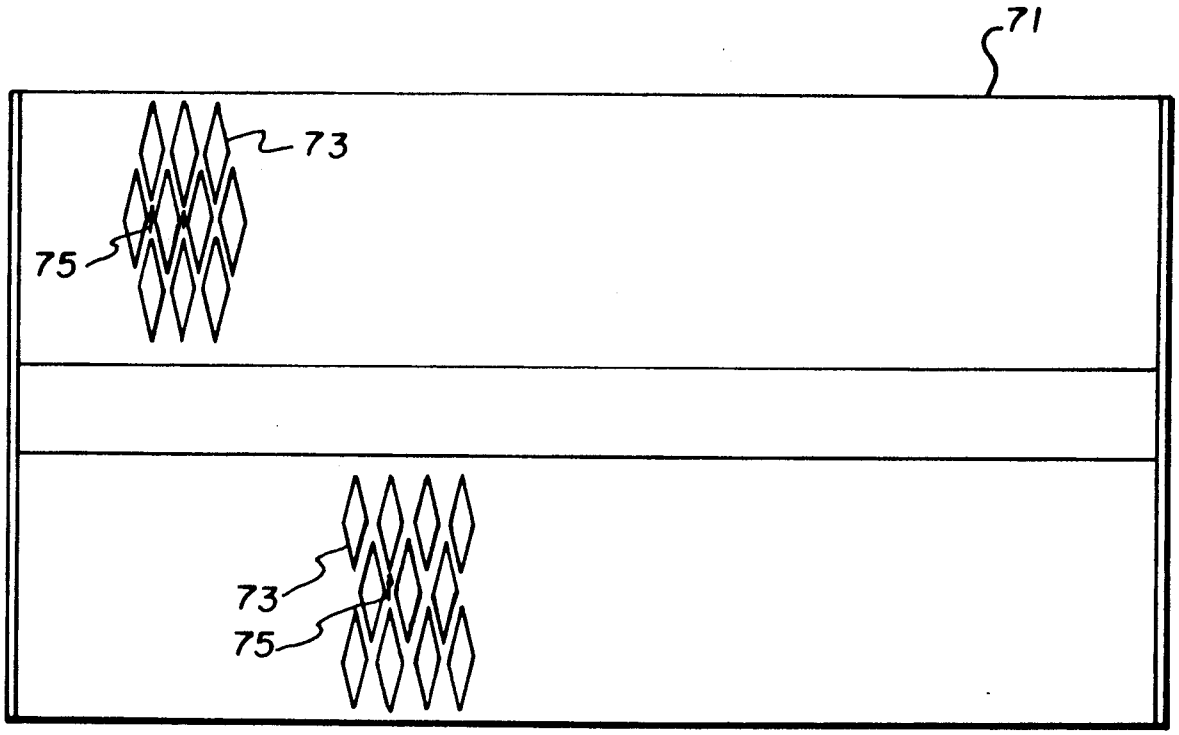
FIG. 8 (PRIOR ART)
FIG. 8 is a top plan view of a prior art inner nozzle.

Referring to FIG. 8 there is illustrated a top plan view of an inner nozzle 71 used in prior fluid suspension processors which define the sides of the processing chamber such as disclosed in U.S. Pat. Nos. 4,989,028; 4,994,840; and 5,059,997. Inner nozzle 75 is similar to inner nozzle 56, like numerals indicating like parts. In particular, the surface 59 of the inner nozzle 56 is provided with a plurality of spaced independent raised projections 73 having a generally diamond shaped configuration to prevent sticking of the film on a planar surface. The arrow 75 indicates the direction of the film path and fluid flow. It is believed that as the processing fluid flows between adjacent projections 73, as indicated by arrow 75, the velocity of the processing fluid increases which tends to pull the film toward the surface of the inner nozzle in this area. As the film moved closer to the surface of the inner nozzle, this pulling force further increases as more fluid is required to move between the film adjacent the surface. This creates an unstable condition such that the film will at some point will bear against the surface of the inner nozzle 71 resulting in artifacts being formed on the film.

Figure 7:
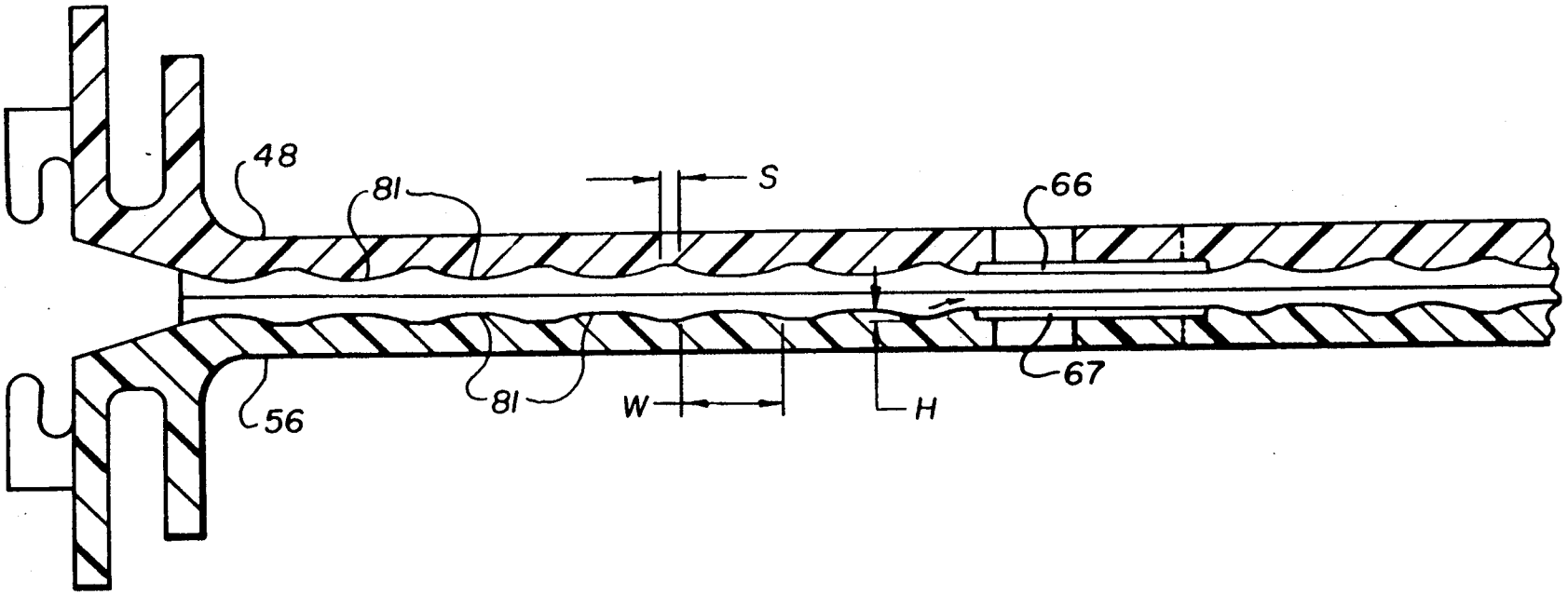
FIG. 7 is an enlarged partial cross-sectional view of the processor of FIG. 4 illustrating a pair of associated inner nozzles which form the processing chamber.

The surface of the inner nozzles 48,56, made in accordance with the present invention, is designed to minimize instability of the film between the two inner nozzles and thereby eliminating or reducing the tendency of the film to be pulled on to surface of the nozzles 48,56. Referring to FIG. 7 there is illustrated an enlarged partial view of inner nozzles 48,56. The surface of the inner nozzles 48,56 are provided with a plurality of projections 81 which extends continuously across the inner nozzles 48,56 in the areas in which the film passes. In the particular embodiment illustrated the projections 81 extend across the entire length L of the inner nozzle 55 (see FIG. 6). The projections 81 provide a barrier such that if the film is pulled toward the surface of the inner nozzle 56, fluid will be trapped directly behind the projection so as to accumulate and at some point will wash past the projection resulting in the film being pushed away form the surface. Since projections 81 are provided on both guide plates 48, 56, a pushing force will be applied on both sides of the photosensitive material passing therethrough. Therefore, the projections 81 provide self adjusting means for stabilizing the film between the two nozzles. In the preferred embodiment illustrated, the projections 57 extend at angle $\beta$ of about degrees with respect to direction of film path (as indicated by arrow 69). However, the present invention is not so limited. It is only important that the projections 81 extend continuously across the film path and provide the pushing action against the film. In the particular embodiment illustrated projections 81 are provided on each side of drains 66,67 and each have a height H an width W1. In the preferred embodiment illustrated, the projections 81 on inner nozzle 48 are disposed opposite the projections on inner nozzle 56. Applicants have found that it is critical that the height be within a certain range, if the height is too small it will not be effective to push the film away from the surface and stabilize the film in the chamber, and if the height of the projections is too large it will interfere with the normal processing of the fluid suspension processor. Applicant have found that the height H of the projection preferably range from about 0.005 inches (0.012 cms) to about 0.030 inches (0.072 cms) and most preferably from about 0.005 inches to about 0.02 inches (0.0508 cms) and has a width W from about 0.02 inches (0.508 cms) to about 0.03 inches (0.762 cms). The projections are spaced a distance S in the range of about 0.2 inches (0.508 cms) to about 0.5 inches (1.27 cms). In the particular embodiment illustrated the distance 5 is about 0.3 inches (0.762 cms).

Figure 7A:
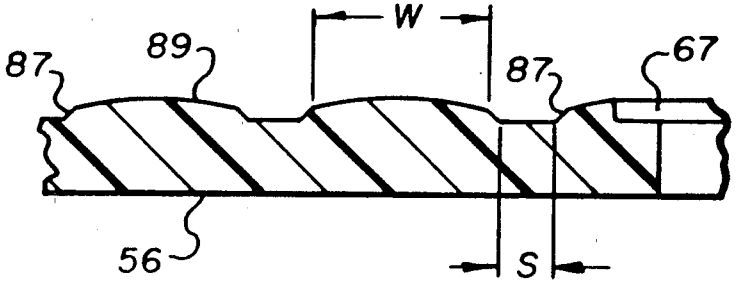
FIG. 7A is a partial enlarged cross-sectional view of a portion of one of the inner nozzles of FIG. 7 as outlined by line 7A—7A which illustrates in greater detail the cross-sectional configuration of the projections.

The projections have a generally semicircular cross-sectional configuration. In the embodiment illustrated, the projections 81 each have a pair of short ramp sections 87 and central section 89 of substantially constant thickness. In the preferred embodiment illustrated in FIG. 7A the drains 66,67 are positioned such next to the ribs 81 such that they directly adjacent the end of the ramp section 87 so that processing fluid is direct away from the surface of the inner nozzle as illustrated by arrow 93. This is believe to assist in maintaining the sheet 12 between the inner nozzles in the area of the drains. It is to be understood the projections 81 can take a variety of other cross-sectional configurations.

As is well known in the art, various other modifications may be made to the processing unit as is customary.

The present invention is directed to an apparatus for processing photosensitive material having a narrow processing chamber through which photosensitive material passes wherein means are provided for minimizing contact of the film with the sides of the processing chamber as the film passes therethrough.

The invention has been described in detail with particular reference to a preferred embodiment thereof, but is to be understood that variations and modifications can be made without departing from the scope of the present invention. For example, but not by way of limitation, the narrow processing chamber may only require a inner nozzle plate on only one side of the photosensitive material, in which case the means for maintaining the photosensitive material away from the inner nozzle need only be provided there. The present invention being limited by the following claims.

We claim:

1. In an apparatus for processing photosensitive material, the apparatus having, a narrow processing chamber formed by a pair of substantially planar guide plates spaced apart a predetermined distance, said processing chamber having an entrance and an exit for allowing the photosensitive material to travel through the processing chamber, first supply means for supplying processing fluid to the processing chamber to create a first fluid layer on one side of the photosensitive material, second supply means for supplying processing fluid to the processing chamber to create a second fluid layer on the opposite side of the photosensitive material; the improvement comprising:

means for inducing a force in the processing fluid so as to cause the processing fluids to provide a force against the photosensitive material so as to minimize contact of the photosensitive material with the guide plates wherein said means for inducing a force in the processing fluid comprises a plurality of raised projections are spaced apart a distance in the range of 0.02 inches (0.508 cms) to 0.5 inches (1.27 cms), said projection being disposed on the surface of the guide plates such that they extend in a substantially perpendicular direction with respect to the direction of travel of the photosensitive material and across substantially the entire width of the photosensitive material.

2. In an apparatus according to claim 1 wherein said projections have a substantially semicircular cross-sectional configuration.

3. In an apparatus according to claim 1 wherein said projections have a height in the range of 0.005 inches (0.127 mm) to about 0.030 inches (0.762 mm).

4. In an apparatus according to claim 1 wherein said projections have a height of about 0.03 inches (0.762 mm).

5. In an apparatus according to claim 1 wherein said projections are spaced apart a distance of about 0.03 inches (0.762 mm) to 0.1 inches (2.54 mm).

6. In an apparatus according to claim 1 wherein said projections are spaced apart a distance of about 0.06 inches (1.524 mm).

7. In an apparatus according to claim 1 wherein said projections have a cross-section width of about 0.24 inches (6.096 mm).

8. In an apparatus according to claim 1 wherein said guide plates each include a drain for removing processing fluid from said first and second fluid layers, said raised projections each having a ramp portion.

9. In an apparatus for processing photosensitive material, the apparatus having an upper tank for retaining a processing fluid and a lower tank for retaining the processing fluid, a narrow processing chamber formed by a pair of spaced planar guide plates disposed between the upper tank and lower tanks, said processing chamber having an entrance at one end and an exit at the other end for allowing the photosensitive material to travel through the chamber, first supply means at the entrance and exit for supplying processing fluid from the upper tank to the processing chamber to create a first fluid layer on one side of the photosensitive material, a first drain located between the entrance and exit for removing processing fluid from the first fluid layer, second supply means at the entrance and exit for supplying processing fluid from the lower tank to the processing chamber to create a second fluid layer on the opposite side of the photosensitive material, a second drain located between the entrance and exit for removing processing fluid from the second fluid layer; the improvement comprising:

means for inducing a force in the processing fluid so as to cause the processing fluids to provide a force against the photosensitive material so as to minimize contact of the photosensitive material with the guide plates wherein said means for inducing a force in the processing fluid comprises a plurality of raised projections are spaced apart a distance in the range of 0.02 inches (0.508 cms) to 0.5 inches (1.27 cms), said projection being disposed on the surface of the guide plates such that they extend in a substantially perpendicular direction with respect to the direction of travel of the photosensitive material and across substantially the entire width of the photosensitive material.

10. In an apparatus according to claim 9 wherein said projections have a substantially semicircular cross-sectional configuration.

11. In an apparatus according to claim 9 wherein said projections have a height in the range of 0.005 inches (0.127 mm) to about 0.030 inches (0.762 mm).

12. In an apparatus according to claim 9 wherein said projections have a height of about 0.03 inches (0.762 mm).

13. In an apparatus according to claim 9 wherein said projections are spaced apart a distance of about 0.03 inches (0.762 mm) to 0.1 inches (2.54 mm).

14. In an apparatus according to claim 9 wherein said projections are spaced apart a distance of about 0.06 inches (1.524 mm).

15. In an apparatus according to claim 9 wherein said projections have a cross-section width of about 0.24 inches (6.096 mm).

16. In an apparatus according to claim 9 wherein said guide plates each include a drain for removing processing fluid from said first and second fluid layers, said raised projections each having a ramp portion, said ramp portion being disposed adjacent the drains.

17. In an apparatus for processing photosensitive material, the apparatus having a narrow processing chamber formed by a pair of substantially planar guide plates spaced apart a predetermined distance, said processing chamber having an entrance and an exit for allowing the photosensitive material to travel through the processing chamber, fist supply means for supplying processing fluid to the processing chamber to create a fist fluid layer on one side of the photosensitive material, second supply means for supplying processing fluid to the processing camber to create a second fluid layer on the opposite side of the photosensitive material; the improvement comprising:

a plurality of spaced raised projections are spaced apart a distance in the range of 0.02 inches (0.508 cms) to 0.5 inches (1.27 cms), said projection being disposed on the surface of the guide plates such that they extend in a substantially perpendicular direction with respect to the direction of travel of the photosensitive material and across substantially the entire width of the photosensitive material.

18. In an apparatus according to claim 17 wherein said projections have a substantially semicircular cross-sectional configuration.

19. In an apparatus according to claim 17 wherein said projections have a height in the range of 0.005 inches (0.127 mm) to about 0.030 inches (0.762 mm).

20. In an apparatus according to claim 17 wherein said projections are spaced apart a distance of about 0.3 inches (0.762 cms).

21. In an apparatus according to claim 17 wherein said guide plates each include a drain for removing processing fluid from said first and second fluid layers, said raised projections each having a ramp portion.

22. In an apparatus for processing photosensitive material, the apparatus having an upper tank for retaining a processing fluid and a lower tank for retaining the processing fluid, a processing chamber located between the upper tank and lower tanks through which the photosensitive material can be advanced for processing the photosensitive material, said processing chamber having an entrance and an exit for allowing the photosensitive material to travel through the chamber, first supply means for supplying processing fluid from the upper tank to the processing chamber to crate a first fluid layer on one side of the photosensitive material, a first drain for removing processing fluid from the first fluid layer, second supply means for supplying processing fluid from the lower tank to the processing chamber to create a second fluid layer on the opposite side of the photosensitive material, a second drain for removing processing fluid from the second fluid layer; the improvement comprising:

a plurality of spaced raised projections have a height in the range of 0.005 inches (.0127 mm) to 0.030 inches (0.762 mm), said projections being disposed on the surface of the guide plates such that they extend in a substantially perpendicular direction with respect to the direction of travel of the photosensitive material and across the entire width of the photosensitive material, said projections providing a pushing action against the photosensitive material so as to minimize contacting of the photosensitive material against the guide plates.

23. In an apparatus according to claim 22 wherein said projections have a height in the range of 0.005 inches (0.127 mm) to about 0.030 inches (0.762 mm).

24. In an apparatus according to claim 22 wherein said guide plates each include a drain for removing processing fluid from said first and second fluid layers, said raised projections each having a ramp portion, said ramp portion being disposed adjacent the drains.

25. In an apparatus for processing photosensitive material, the apparatus having, a narrow processing chamber having at least one substantially planar guide plate forming one side of the processing chamber, said processing chamber having an entrance and an exit for allowing the photosensitive material to travel through the processing chamber, first supply means for supplying processing fluid to the processing chamber to crate a first fluid layer on one side of the photosensitive material; the improvement comprising:

means for including a force in the processing fluid comprises a plurality of raised projections are spaced apart a distance in the range of 0.02 inches (0.508 cms) to 0.5 inches (1.27 cms), said projection being disposed on the surface of the guide plates such that they extend in a substantially perpendicular direction with respect to the direction of travel of the photosensitive material and across substantially the entire width of the photosensitive material so as to cause the processing fluids to provide a force against the photosensitive material so as to minimize contact of the photosensitive material with the guide plate.

26. In an apparatus according to claim 25 wherein said projections have a substantially semicircular cross-sectional configuration.

27. In an apparatus according to claim 25 wherein said projections have a height in the range of 0.005 inches (0.127 mm) to about 0.030 inches (0.762 mm).

28. In an apparatus according to claim 25 wherein said projections have a height of about 0.03 inches (0.762 mm).

29. In an apparatus according to claim 25 wherein said projection are spaced apart a distance of about 0.03 inches (0.762 mm) to 0.1 inches (2.54 mm).

30. In an apparatus according to claim 25 wherein said projections are spaced apart a distance of about 0.06 inches (1.524 mm).

31. In an apparatus according to claim 25 wherein said projections have a cross-section width of about 0.24 inches (6.096 mm).

32. In an apparatus according to claim 25 wherein said at least one guide plate each include a drain for removing processing fluid from said first layer, said raised projections each having a ramp portion.

33. In an apparatus for processing photosensitive material, the apparatus having an upper tank for retaining a processing fluid and a lower tank for retaining the processing fluid, a processing chamber located between the upper tank and lower tanks through which the photosensitive material can be advanced for processing the photosensitive material, said processing chamber having an entrance and an exit for allowing the photosensitive material to travel through the chamber, first supply means for supplying processing fluid from the upper tank to the processing chamber to create a first fluid layer on one side of the photosensitive material, a first drain for removing processing fluid from the first fluid layer, second supply means for supplying processing fluid from the lower tank to the processing chamber to create a second fluid layer on the opposite side of the photosensitive material, a second drain for removing processing fluid from the second fluid layer; the improvement comprising:

a plurality of spaced raised projections are spaced apart a distance in the range of 0.2 inches (0.508 cms) to 0.5 inches (1.27 cms), said projections being disposed on the surface of the guide plates such that they extend in a substantially perpendicular direction with respect to the direction of travel of the photosensitive material and across the entire width of the photosensitive material, said projections providing a pushing action against the photosensitive material so as to minimize contacting of the photosensitive material against the guide plates.

34. In an apparatus according to claim 33 wherein said projections are spaced apart a distance of about 0.3 inches (0.762 cms).

35. In an apparatus for processing photosensitive material, the apparatus having an upper tank for retaining a processing fluid and a lower tank for retaining the processing fluid, a processing chamber located between the upper tank and lower tanks through which the photosensitive material can be advanced for processing the photosensitive material, said processing chamber having an entrance and an exit for allowing the photosensitive material to travel through the chamber, first supply means for supplying processing fluid from the upper tank to the processing chamber to create a first fluid layer on one side of the photosensitive material, a first drain for removing processing fluid from the first fluid layer, second supply means for supplying processing fluid from the lower tank to the processing chamber to create a second fluid layer on the opposite side of the photosensitive material, a second drain for removing processing fluid from the second fluid layer; the improvement comprising:

a plurality of spaced raised projections comprises a plurality of raised projections have a cross-section width of about 0.24 inches (6.096 mm), said projections being disposed on the surface of the guide plates such that they extend in a substantially perpendicular direction with respect to the direction of travel of the photosensitive material and across the entire width of the photosensitive material, said projections providing a pushing action against the photosensitive material so as to minimize contacting of the photosensitive material against the guide plates.

* * * * *